US006267653B1

(12) United States Patent
Klink et al.

(10) Patent No.: US 6,267,653 B1
(45) Date of Patent: Jul. 31, 2001

(54) DEVICE FOR GRINDING AN END FACE, ESPECIALLY AN ANNULAR SURFACE AT THE EDGE OF A WORKPIECE BORE

(75) Inventors: Ulrich Klink, Neuffen; Richard Stampfer, Wendlingen; Hermann Schmidt, Reutlingen; Dieter Aulich, Gomaringen; Jörg Wolfgramm, Kusterdingen, all of (DE)

(73) Assignees: Maschinenfabrik Gehring GmbH & Co., Ostfildern; Robert Bosch GmbH, Stuttgart, both of (DE)

( * ) Notice: Subject to any disclaimer, the term of this patent is extended or adjusted under 35 U.S.C. 154(b) by 0 days.

(21) Appl. No.: 08/844,706

(22) Filed: Apr. 18, 1997

(30) Foreign Application Priority Data

Apr. 20, 1996 (DE) ..... 296 07 203 U

(51) Int. Cl.[7] ..... B24B 15/02

(52) U.S. Cl. ..... 451/271; 451/278; 451/282; 451/430; 451/115

(58) Field of Search ..... 451/259, 270, 451/271, 278, 282, 430, 115

(56) References Cited

U.S. PATENT DOCUMENTS

| | | | | |
|---|---|---|---|---|
| 2,226,207 | * | 11/1940 | Wilhide | 451/430 |
| 2,443,489 | * | 6/1948 | Weynand | 451/430 |
| 2,525,119 | * | 10/1950 | Dunn | 451/430 |
| 2,754,642 | * | 7/1956 | Soulet | 451/430 |
| 2,769,287 | * | 11/1956 | Arp | 451/430 |
| 2,809,482 | * | 10/1957 | Soulet | 451/430 |
| 4,467,566 | * | 8/1984 | Ondrus, Jr. et al. | 451/430 |

FOREIGN PATENT DOCUMENTS 4441623 6/1995 (DE) .

* cited by examiner

*Primary Examiner*—Eileen P. Morgan
(74) *Attorney, Agent, or Firm*—Robert W. Becker & Associates

(57) ABSTRACT

A device for grinding an end face at an edge of a workpiece bore of a workpiece has a driven grinding tool and a guide pin, connected to the grinding tool, for insertion into the workpiece. The guide pin is dimensioned so as to precisely match the workpiece bore. The guide pin has a central axis. The grinding tool has a grinding surface extending angularly to the central axis. The grinding tool is periodically displaceable transverse to the central axis.

20 Claims, 3 Drawing Sheets

DEVICE FOR GRINDING AN END FACE, ESPECIALLY AN ANNULAR SURFACE AT THE EDGE OF A WORKPIECE BORE

BACKGROUND OF THE INVENTION

The present relates to a grinding device for grinding an end face, especially an annular surface, at the edge of a workpiece bore with a driven grinding tool, the grinding surface of which extends angularly relative to the axis of a guide pin which for a precise introduction into the machined (for example, honed) bore has an identical size (identical dimensions) and which is connected to the grinding tool.

A known device of this kind is disclosed in German patent application 44 41 623 A1 and serves for fine machining a chamfer at the edge of a workpiece bore which serves as a sealing seat for a valve needle. Such valve bores are, for example, provided for injection pumps of combustion engines. They have a very small diameter of only a few millimeters and must be machined very precisely. The end face forming the edge of the bore and surrounding the bore of the workpiece must also be machined very precisely. For grinding or other surface machining of a chamfer, it must be taken into consideration that the truncated cone surface must be positioned exactly concentrically to the axis of the workpiece bore. The known device has a grinding tool with a conical grinding surface for the purpose of surface machining of the chamfer. The grinding tool with its grinding surface is driven so as rotate about the axis of the bore. The shape of the chamfer depends directly on the shape of the grinding surface of the grinding pad which in mass production must be frequently subjected to a trueing or dressing process. Since grinding pads or coatings are in general inhomogeneous, the shape precision and the surface quality of the chamfer in mass production is often unsatisfactory for high-precision workpieces.

Plane honing devices are also known in which the honing tool is displaced with its grinding coating or pad on the surface to be machined. These devices however can not be used for machining processes with limited available space because of their relatively large size.

It is therefore an object of the present invention to embody a device requiring only little space, i.e., space as small as possible, that can produce or machine small end faces, especially annular surfaces at the edge of a bore, with very high precision.

Summary of the Invention

The device for grinding an end face at an edge of a workpiece bore of a workpiece according to the present invention is primarily characterized by:

A driven grinding tool;

A guide pin, connected to the grinding tool, for insertion into the workpiece bore, wherein the guide pin is dimensioned so as to precisely match the workpiece bore;

The guide pin having a central axis;

The grinding tool having a grinding surface extending angularly to the central axis;

Wherein the grinding tool is periodically displaceable transverse to the central axis.

The device preferably further comprises a drive shaft having a rotational axis, wherein the central axis of guide pin is aligned with the rotational axis.

The guide pin is preferably connected to the drive shaft. The drive shaft has a throughbore extending transverse to the central axis of the guide pin. The grinding tool is displaceably guided within the throughbore.

Advantageously, the drive shaft is a telescopic shaft comprising an inner shaft and an outer shaft, wherein the outer shaft is driven and the inner shaft is axially displaceable within the outer shaft.

The outer shaft has a longitudinal slot. The inner shaft comprises a transverse bolt penetrating the inner shaft and guided within the longitudinal slot. The transverse bolt provides a positive-locking connection between the inner shaft and the outer shaft in a rotational direction of the drive shaft.

Preferably, the inner shaft is biased in direction toward the workpiece.

For this purpose, the device further comprises a pressure spring acting on the inner shaft for biasing in the direction toward the workpiece and further comprises a control screw for adjusting the tension of the spring.

Preferably, the inner shaft and the guide pin form an integral part.

Expediently, the device further comprises an eccentric part for periodically transversely displacing the grinding tool relative to the central axis.

Preferably, the device further comprises a driven hollow shaft, wherein the eccentric part is integrally connected to the driven hollow shaft and comprises an eccentric bore that is eccentric relative to a drive axis of the hollow shaft. The grinding tool comprises a holding device positioned in the eccentric bore so as to be displaceable transverse to the drive axis of the hollow shaft.

Preferably, the holding device is a cylindrical slide having opposed end faces that are convex and are supported glidingly on the inner wall of the eccentric bore.

The grinding tool is a plane honing tool comprising at least one honing strip having a honing pad (coating) forming a grinding surface of the honing tool.

The throughbore has preferably a keyhole shape in cross-section including a longitudinal slot projecting into the guide pin. The honing pad of the at least one honing strip projects from the slot toward the guide pin at least at on end of the slot in a longitudinal direction thereof.

The drive shaft is supported within the hollow shaft and the drive shaft and the hollow shaft and the drive shaft and the hollow shaft are operated in opposite directions of rotation.

The device may further comprise a drive pinion, wherein the drive shaft has a toothed section with an outer toothing and the hollow shaft has a toothed section with an inner toothing and wherein the toothed section of the drive shaft is positioned within the toothed section of the hollow shaft. The drive pinion is positioned between the inner and the outer toothings.

The device may also comprise a securing device for the workpiece, whereby the securing device includes a gimbal-mounted clamping device for clamping the workpiece.

The guide pin has at least one guide strip for supporting the guide pin at the inner wall at the workpiece bore.

The grinding surface of the grinding tool may be displaceably perpendicularly to the central axis of the guide pin.

The grinding surface of the grinding tool may instead also be displaceable at an angle to the central axis of the guide pin, wherein the angle is identical to the desired chamfer angle at the edge of the workpiece bore.

Preferably, the grinding tool is advancable in the direction toward the workpiece.

The periodic displacement of the grinding tool transverse to the central axis of the guide pin allows a surface-machining of the end face of workpieces and also the generation of a chamfer at the edge of the workpiece bore with a planar grinding surface, the shape of which is thus not changed by wear and subsequent trueing or dressing operations so that in mass production a very high precision and quality of the machined surface can be achieved. The displacement movement can be realized within a small amount of space so that a minimal constructive height of the entire device results.

During the displacement movement the grinding tool is expediently driven in rotation with a drive shaft, for example, at 2,000 to 6,000 rpm, whereby the periodic displacement is produced with an eccentric part that is preferably a component of the driven hollow shaft with an eccentric bore. Preferably, the hallow shaft is operated counter to the direction of rotation of the drive shaft with 500 to 2,000 rpm. The travel stroke of the transverse displacement is selected such that the grinding surface completely covers the end face to be machined whereby the travel stroke for machining of the surrounding area (edge) of very thin bores is, for example, 0.5 to 3 mm.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments.

Figure 1:
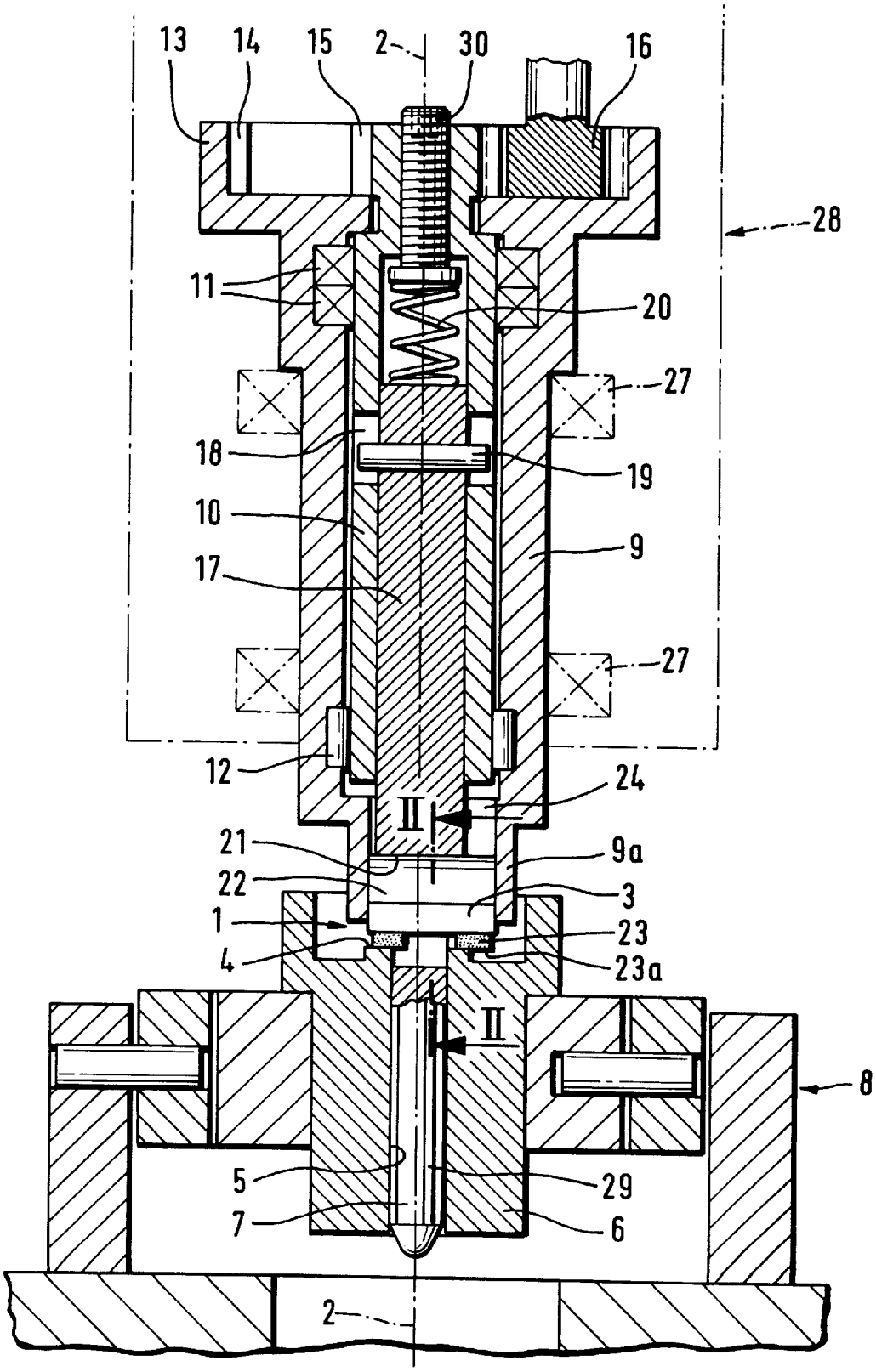
FIG. 1 shows the grinding device with a correlated securing device for the workpiece in axial section.
Figure 3:
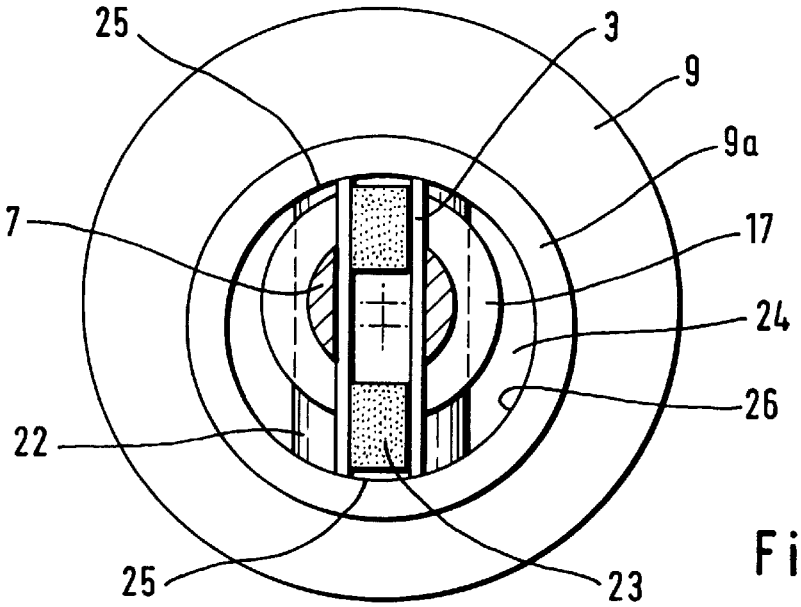
FIG. 3 shows a section along the line III—III of FIG. 2.
Figure 2:
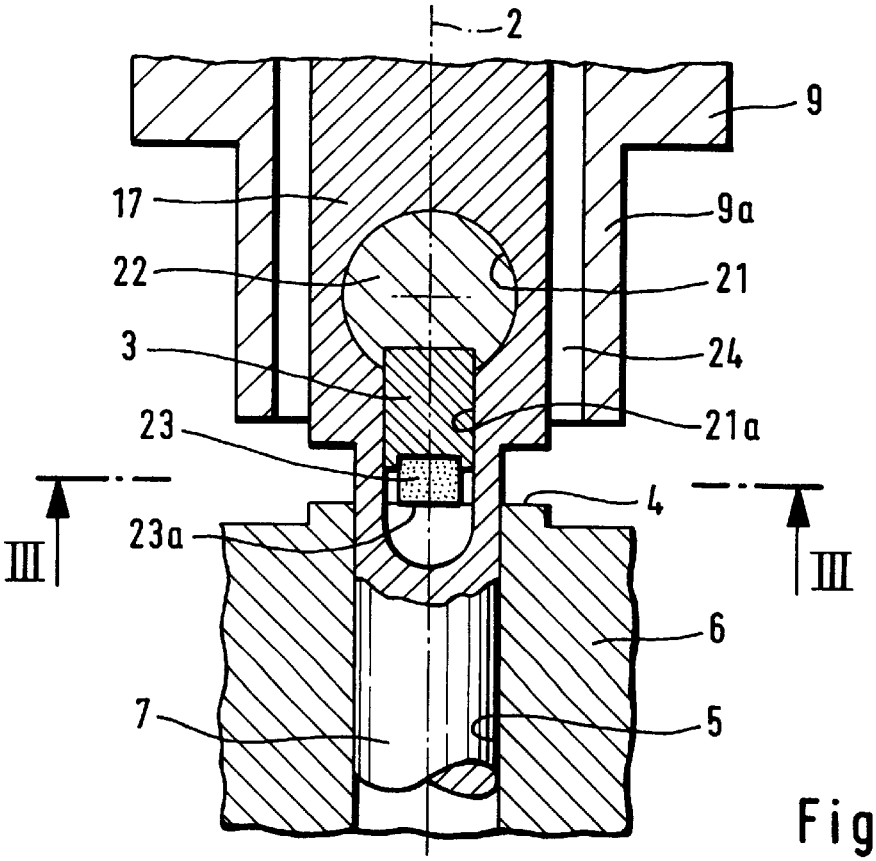
FIG. 2 shows a section along the line II—II of FIG. 1.

The device according to FIGS. 1–3 has a grinding tool that is embodied as a honing strip 3 with a grinding pad or coating 23 and that is secured to a holding device 22. The holding device 22 is a cylindrical slide into which the honing strip 3 is inserted parallel to its axis. The holding device or slide 22 is displaceable in a throughbore 21 of a shaft 17. The shaft 17 and the guide pin 7 form an integral part. The guide pin 7 is positioned in the bore 5 of the workpiece 6 which has been finish-honed. The workpiece 6 is supported in a manner known per se in the securing device 8 comprising a gimbal-type support for a workpiece clamping device so that the workpiece 6 is always precisely aligned with the aid of the guide pin 7 relative to the central axis 2 which coincides with the rotational axis of the shaft 17. The shaft 17 is the inner member of a telescopic drive shaft. The outer shaft 10 is supported in hollow shaft 9 with bearings 11 and 12. The shaft 17 is positive-lockingly connected by a transverse bolt 19 to the outer shaft 10 in the rotational direction of the drive shaft (10, 17). The transverse bolt 19 penetrates the inner shaft 17 and rests with its ends in a longitudinal slot 18 of the outer shaft 10. A pressure spring 20 positioned within the outer shaft 10 loads (or biases) the inner shaft 17 toward the workpiece 6. The spring tension can be adjusted with the control screw 30 which is inserted into the upper end of the outer shaft 10. The inner shaft 17 is displaceable in the axial direction within the outer shaft 10 by tensioning (loading) with the pressure spring 20. The displacement stroke of the inner shaft 17 is limited by the length of the longitudinal slot 18.

The drive shaft (10, 17) and the hollow shaft 9 are driven in opposite rotational directions. The outer shaft 10 of the drive shaft for this purpose is provided at its upper end with an outer toothing 15. This upper end is positioned within a cup-shaped section 13 of the hollow shaft 9 which in this area is provided with an inner toothing 14. A drive pinion 16 engages the two toothings 14 and 15.

The hollow shaft 9 has an eccentric bore 24 within its lower section 9*a*. The bore 24 and the section 9*a* are eccentric to the common axis 2, of the shafts 10, 17, 9 and of the guide pin 7 so that an eccentric part is formed (rotational axis, drive axis). As is shown in FIGS. 2 and 3, the cylindrical slide 22 is positioned in the throughbore 21 of the inner shaft 17 such that it rests with its two convex end faces 25 face to face at the wall 26 of the eccentric bore 24 and is thus glidingly supported thereat. The throughbore 21 is of a key hole shape because of the slot 21*a* extending into the guide pin 7. The slide 22 rests glidingly at the cylindrical wall of the through bore 21 while the honing strip 3 is positioned and supported within the slot 21*a* (FIG. 2). In the area of the guide pin 7 the honing strip 3 projects with its grinding pad (coating) 23 at both ends of the strip 3 from the slot 23*a* to the exterior (FIG. 1), i.e., toward the workpiece 6. The grinding pad 23 can pass across the entire end face 4 of the workpiece 6 to be machined with its grinding surface 23*a*.

The hollow shaft 9 is supported with bearings 27 in the device support 28 indicated with dash-dotted lines. The device support 28 is advanceable in the axial direction toward the workpiece 6 within guides that are not represented in the drawing.

Before beginning the machining operation, the support 28 and the securing device 8 are aligned relative to one another such that the guide pin 7 extends coaxially to the workpiece bore 5. The support 28 is advanced in the direction toward the workpiece 6 for introducing the guide pin 7 into the workpiece bore 5 which is to be machined by honing or by finish machining. The workpiece 6 during this process will undergo alignment with the gimbal-type clamping support so as to be precisely aligned with the central axis 2 which then coincides with the axis of the workpiece bore. The guide pin 7 can be provided with a wear-resistant coating or may have a guide strip 29 that is comprised of a wear-resistant material, for example, a hard metal.

The advancing movement can be controlled in a manner known per se as a function of the travel stroke and can also be additionally controlled so as to be force-dependent whereby a stepwise or continuous advancing movement is possible. Shortly before the grinding pad 23 of the honing strip 3 comes into contact with the annular surface 4 of the workpiece 6, the opposite rotational movements of the drive shaft (10, 17) and of the hollow shaft 9 are started with the drive pinion 16. For this purpose, the advancing movement can be slowed or interrupted for a short period of time. Upon further advancement the grinding surface 23*a* of the grinding pad 23 will come to rest at the workpiece surface 4 which is then machined by a rotating movement and at the same time by a radial periodic displacement movement of the grinding tool 1. The rotation is generated by the drive shaft 10, 17 and the displacement movement by the eccentric part 9*a* of the hollow shaft 9. The slide 22 with its end faces 25 glide along the wall 26 of the eccentric bore 24 and are thus displaced together with the honing strip 3 in the throughbore 21, 21*a* radially to the axis 2 in a periodic counter movement. With this combined movement, the grinding surface 23*a* will cover the entire annular workpiece surface 4.

During machining, due to the continuous or stepwise further advancement, the pressure spring 20 is continuously tensioned. The advancing movement is stopped as soon as the grinding pad 23 of the honing strip 3 rests under pressure of the spring 20 with the predetermined machining force at the workpiece surface 4. The machining force to be preset is adjustable by selecting the advancing stroke, or, for a continuous advancing, by adjusting the spring force with the control screw 30. For turning off the advancing movement when reaching the predetermined final position has been reached, travel and/or force measuring devices can be provided.

Figure 4:
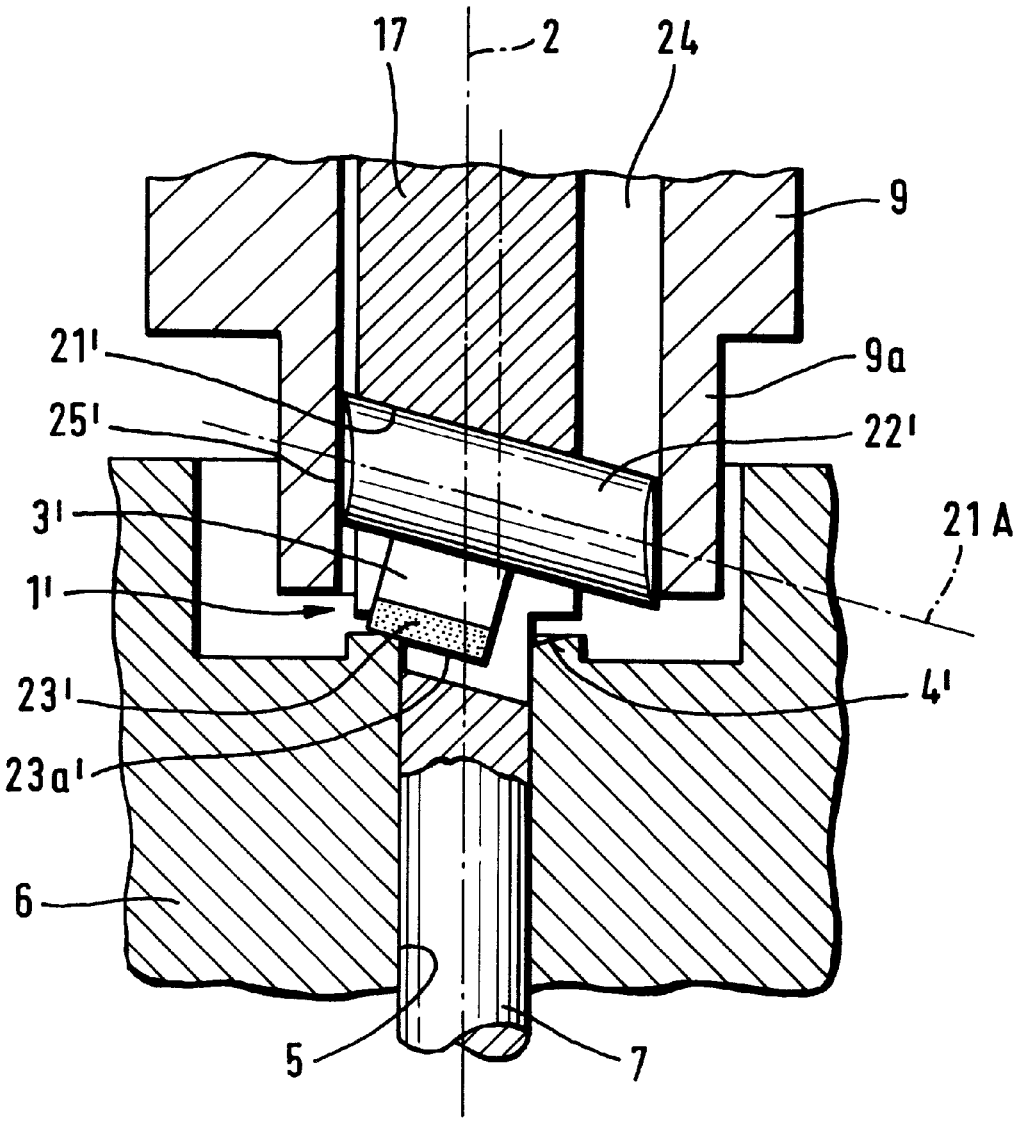
FIG. 4 shows schematically an axial section of the device and of the workpiece to be machined in a further embodiment and different support of the tool.

FIG. 4 shows the device in the area of the machining zone in an enlarged axial view. In this embodiment, a grinding tool 1' is employed with which the edge of the workpiece bore 5 is to be provided with a chamfer in the form of a conical annular surface 4'. The chamfer 4' can be generated with the grinding tool 1' by removing the edge of the bore. However, it is also possible to finish-machine the surface of an already present, previously generated, chamfer to a precise dimension exactly concentrically to the axis 2.

The grinding tool 1' is comprised of a honing strip 3' having a grinding pad 23' which is inserted, corresponding to the representation of FIG. 2, into the slide 22'. A through-bore 21' of the shaft 17 extends also into the guide pin 7, but extends with its central axis 21A of the upper area at a slant to the axis 2 of the guide pin 7. The cylindrical slide 22' is accordingly arranged at a slant relative to the shaft 17 so that its convex end faces 25' are at a slant when viewed in axial section. The center axis of the slide 22' coincides with the axis 21A of the throughbore and the grinding surface 23*a*' of the grinding pad 23' is positioned parallel to this axis 21A. The angle between the grinding surface 23*a*' and the axis 2 corresponds to the desired angle of the chamfer 4'. The honing strip 3' is dimensioned such that and arranged at the slide 22' such that it extends partly into the workpiece bore 5 and, during the rotation and displacement movements of the tool 1', will pass across the entire conical annular surface, respectively, chamfer 4'. The rotational and displacement movements are generated, as disclosed above, with their drive shaft (10, 17) and the hollow shaft 9.

The present invention is, of course, in no way restricted to the specific disclosure of the specifications, and drawings, but also encompasses any modifications within the scope of the appended claims.

What we claim is:

1. A device for grinding an end face at an edge of a workpiece bore of a workpiece, said device comprising:

a driven grinding tool;

a guide pin, connected to said grinding tool, for insertion into the workpiece bore, wherein said guide pin is dimensioned so as to precisely match the workpiece bore;

said guide pin having a central axis;

said grinding tool having a grinding surface extending angularly to said central axis;

wherein said grinding tool is periodically displaceable transverse to said central axis.

2. A device according to claim 1, further comprising a drive shaft having a rotational axis, wherein said central axis of said guide pin is aligned with said rotational axis.

3. A device according to claim 2, wherein:

said guide pin is connected to said drive shaft;

said drive shaft has a throughbore extending transverse to said central axis of said guide pin;

said grinding tool is displaceably guided within said throughbore.

4. A device according to claim 3, wherein said drive shaft is a telescopic shaft comprising an inner shaft and an outer shaft, wherein said outer shaft is driven and wherein said inner shaft is axially displaceable within said outer shaft.

5. A device according to claim 4, wherein:

said outer shaft has a longitudinal slot;

said inner shaft comprises a transverse bolt penetrating said inner shaft and guided within said longitudinal slot;

said transverse bolt providing a positive-locking connection between said inner shaft and said outer shaft in a rotational direction of said drive shaft.

6. A device according to claim 4, wherein said inner shaft is biased in a direction toward the workpiece.

7. A device according to claim 6, further comprising a pressure spring acting on said inner shaft for biasing in the direction toward the workpiece and further comprising a control screw for adjusting the tension of said spring.

8. A device according to claim 4, wherein said inner shaft and said guide pin form an integral part.

9. A device according to claim 3, further comprising an eccentric part for periodically transversely displacing said grinding tool relative to said central axis.

10. A device according to claim 9, further comprising a driven hollow shaft, wherein said eccentric part is integrally connected to said driven hollow shaft and comprises an eccentric bore that is eccentric relative to a drive axis of said hollow shaft, wherein said grinding tool comprises a holding device positioned in said eccentric bore so as to be displaceable transverse to said drive axis of said hollow shaft.

11. A device according to claim 10, wherein said holding device is a cylindrical slide having opposed end faces that are convex and are supported glidingly on an inner wall of said eccentric bore.

12. A device according to claim 10, wherein said grinding tool is a plane honing tool comprising at least one honing strip having a honing pad forming a grinding surface of said honing tool.

13. A device according to claim 12, wherein said through-bore has a keyhole shape in cross-section including a longitudinal slot projecting into said guide pin, wherein said honing pad of said at least one honing strip projects from said slot toward said guide pin at least at one end of said slot in a longitudinal direction thereof.

14. A device according to claim 10, wherein said drive shaft is supported within said hollow shaft and wherein said drive shaft and said hollow shaft are operated in opposite directions of rotation.

15. A device according to claim 14, further comprising a drive pinion, wherein:

said drive shaft has a toothed section with an outer toothing;

said hollow shaft has a toothed section with an inner toothing;

said toothed section of said drive shaft is positioned within said toothed section of said hollow shaft;

said drive pinion is positioned between said inner and said outer toothings.

16. A device according to claim 1, further comprising a securing device for the workpiece, said securing device including a gimbal-mounted clamping device for clamping the workpiece.

17. A device according to claim 1, wherein said guide pin has at least one guide strip for supporting said guide pin at an inner wall of the workpiece bore.

18. A device according to claim 1, wherein said grinding surface of said grinding tool is displaceable perpendicularly to said central axis of said guide pin.

19. A device according to claim 1, wherein said grinding surface of said grinding tool is displaceable at an angle to said central axis of said guide pin, wherein said angle is identical to a desired chamfer angle at the edge of the workpiece bore.

20. A device according to claim 1, wherein said grinding tool is advanceable in a direction toward the workpiece.

* * * * *